US006405492B1

(12) United States Patent
Scheid et al.

(10) Patent No.: US 6,405,492 B1
(45) Date of Patent: Jun. 18, 2002

(54) MOBILE WORKING APPARATUS

(75) Inventors: Winfried Scheid, Ebersbach; Nikodemus Heinz, Albershausen, both of (DE)

(73) Assignee: Delmag Maschinenfabrik (DE)

( * ) Notice: Subject to any disclaimer, the term of this patent is extended or adjusted under 35 U.S.C. 154(b) by 0 days.

(21) Appl. No.: 09/638,618

(22) Filed: Aug. 15, 2000

(30) Foreign Application Priority Data

Aug. 18, 1999 (DE) ..... 199 38 578

(51) Int. Cl.[7] ..... B66C 23/00

(52) U.S. Cl. ..... 52/114; 52/111; 52/116; 52/123.1; 52/126.1; 52/749.1; 212/261; 212/300; 414/DIG. 917

(58) Field of Search ..... 52/114, 111, 115, 52/119, 116, 123.1, 126.1, 749.1; 212/261, 300; 414/DIG. 917

(56) References Cited

U.S. PATENT DOCUMENTS 2,527,818 A * 10/1950 Ives ..... 248/2
2,678,741 A * 5/1954 Pilch ..... 414/727
3,648,856 A * 3/1972 Gaarder et al. ..... 214/1 D
3,862,697 A * 1/1975 Gill et al. ..... 214/763
4,088,289 A * 5/1978 Wood et al. ..... 248/2
4,175,907 A * 11/1979 Knell et al. ..... 414/715
4,185,945 A * 1/1980 Gill ..... 414/727
4,218,171 A * 8/1980 Guinot ..... 414/694
4,400,994 A * 8/1983 Skjaeveland ..... 74/520
4,606,694 A * 8/1986 Meisel, Jr. et al. ..... 414/732
4,655,097 A * 4/1987 Suzuki ..... 74/53
4,775,029 A * 10/1988 MacDonald et al. ..... 182/2
5,577,878 A * 11/1996 Brown ..... 414/708

FOREIGN PATENT DOCUMENTS

EP 0 861 967 9/1998

* cited by examiner

*Primary Examiner*—Carl D. Friedman
*Assistant Examiner*—Phi Dieu Tran A
(74) *Attorney, Agent, or Firm*—Factor & Partners

(57) ABSTRACT

In order to be able to shift a leader (18), which is disposed on a travelling chassis (10) via a carrying mechanism (16), both towards the front and also towards the rear into a substantially horizontal position, the carrying mechanism (16) has at least one guide arm (24) which is adjustable in length and which comprises a double-acting hydraulic working cylinder.

9 Claims, 5 Drawing Sheets

MOBILE WORKING APPARATUS

BACKGROUND OF THE INVENTION

The invention relates to a mobile travelling apparatus.

BACKGROUND ART

A travelling apparatus is disclosed in EP 0 861 967 A2. In the said apparatus, the leader, which may, in practice, be extremely high (20 to 40 m), can be folded down out of a vertical working position into a horizontal assembly position located in front of the travelling chassis and be disassembled in the said position for the purpose of transporting the working apparatus. The travelling chassis, which has a distinctly lower weight and smaller dimensions than the working apparatus when the latter is ready for operation, can then be transported by road or rail to a different place of use.

For many cases of application, it would be desirable if it were possible, for dismantling purposes, to shift the leader out of the vertical working position not only towards the front but also towards the rear, so that it is located above the travelling chassis in such a way as to project beyond the latter both towards the front and towards the rear. In such a position, a leader which is not excessively long can still be transported over roads and railway lines which do not have excessively sharp curves or similar obstacles, without being disassembled. This results in a saving on assembly time.

The intention is to further develop a working apparatus in such a way, by means fo the invention, that the leader can be shifted towards the front or towards the rear alternatively.

SUMMARY OF THE INVENTION

This object is achieved, according to the invention, by means of a mobile working apparatus having a travelling chassis, with a leader which is carried via a carrying mechanism so as to be displaceable between a substantially vertical working position and a substantially horizontal assembly position, the carrying mechanism having two carrying guide arms located at a distance from one another, the first ends of which are connected, via first pivot bearings located at a distance from one another, to the travelling chassis, and the second ends of which are connected, via two pivot bearings located at a distance from one another, to an intermediate guide arm which is connected to the leader via a third pivot bearing and carries, via a fourth pivot bearing a neck-support arrangement which acts on the leader with its free end via a fifth pivot bearing which is located at a distance from the third pivot bearing, wherein at least one of the two carrying guide arms can be adjusted in its length.

There are advantageous further developments of the invention.

A further development of the invention is distinguished by a particularly robust and mechanically simple design of the carrying guide arm, which is constructed as a strut.

What is achieved in accordance with a further development of the invention is that it is not necessary to release any mechanical locking systems for the purpose of shifting the leader. The transition of the guide-arm arrangement from a substantially parallelogram-type guide-arm arrangement, which is advantageous for changes in location of the leader which is erected substantially vertically when ready for operation, to a trapezoidal guide-arm arrangement, which is advantageous for shifting purposes, can also be effected in a continuous manner and thus influence the way in which the leader is shifted on each occasion.

A further development of the invention guarantees, in a simple manner, the locking of the carrying guide-arm arrangement in the geometry desired on each occasion.

A further development of the invention is of advantage with respect to simple detachment of the leader from the travelling chassis and its easy reattachment to the latter.

There are preferred length ratios for the various guide arms and the location of the various pivot bearings of the leader-carrying mechanism.

A development is of advantage with respect to a lower overall height of the working apparatus when in the transport configuration.

In a working apparatus, it is possible to detach the leader from the travelling chassis even when it is shifted towards the rear, or to attach it to the said chassis in such a way that it can be erected upwards after being attached from the rear.

BRIEF DESCRIPTION OF THE DRAWINGS

The invention will be explained in greater detail below with the aid of exemplified embodiments and with reference to the drawings, in which.

DESCRIPTION OF THE PREFERRED EMBODIMENT

Figure 1:
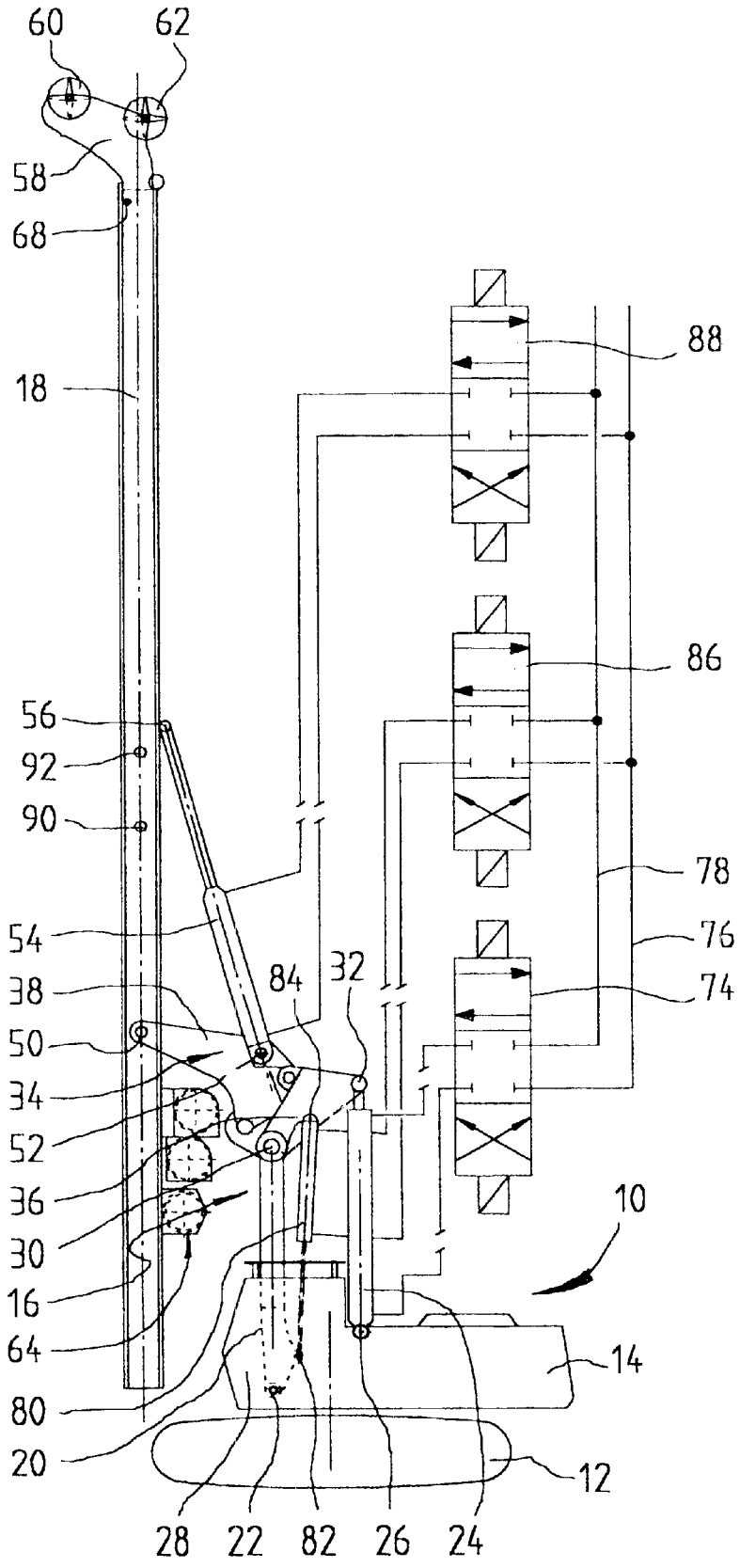
FIG. 1 shows a lateral view of a mobile working apparatus, wherein a leader belonging to the said apparatus is portrayed in its vertical working position.

In FIG. 1, a travelling chassis for a mobile working apparatus (for example a ramming or drilling appliance), which chassis has tracked running gear 12 and a superstructure 14 carried by the latter, is indicated, as a whole, by 10.

Via a carrying mechanism, which is designated as a whole by 16, the travelling chassis 10 carries a leader 18. When the working apparatus is ready for operation, the said leader carries a drilling arrangement, ramming arrangement or the like (not represented in the drawings), which is capable of travelling along the leader 18.

The carrying mechanism 16 comprises a first carrying guide arm 20 which has a fixed length and is connected, at one of its ends, to a lower, central front section of the superstructure 14 in an articulated manner via a first pivot bearing 22. A second carrying guide arm 24 is constructed as a hydraulic working cylinder and is connected, by its end which is on the vehicle, to the upper, central front region of the front side of the superstructure 14 via another first pivot bearing 26. In this way, the first carrying guide arm 20 and the second carrying guide arm 24 extend in a plane which lies behind a driver's cab 28 belonging to the travelling chassis 10, as is indicated by broken lines in the case of parts of the carrying guide arms.

The second ends of the two carrying guide arms 20, 24 are connected, via second pivot bearings 30, 32, to an intermediate guide arm which is designated, as a whole, by 34. The latter comprises two intermediate guide-arm parts 36, 38 which are connected to one another via a releasable coupling which, in the exemplified embodiment represented, comprises a hook-shaped coupling nose 40 carried by the coupling part 36, and a coupling aperture 42 belonging to the first intermediate guide-arm part 36 and located at a distance from the said coupling nose, as can be seen from FIGS. 2 and 3 in particular. The coupling nose 40 interacts with a coupling pin 44 which is disposed on the second intermediate guide-arm part 38. When the coupling nose 40 engages round the coupling pin 44, the coupling aperture 42 aligns with a coupling aperture 46 which is constructed in the second intermediate guide-arm part 38. When the leader is attached, a coupling pin 48 is inserted through the two coupling apertures 42, 46, as shown in FIGS. 2 and 4.

The intermediate guide-arm part 36 is connected to the leader 18 in an articulated manner via a third pivot bearing 50. The intermediate guide-arm part 38 also carries, via a fourth pivot bearing 52, the lower end of a neck support 54 (or of a pair of neck supports, of which one is to be imagined as being in front of the plane of the drawing, and the other behind it). The upper end of the piston rod of the neck support 54 is likewise connected to the leader via a fifth pivot bearing 56.

At the upper end of the leader 18, a leader head segment 58 is provided which carries deflecting pulleys 60, 62 for wire cables which are not portrayed but which are actuated via a winding unit 64 which is provided on the rear side of the leader 18. These wire cables serve for moving various loads, in particular for handling drilling rods and drilling tubes, and also for moving a drilling table. In the case of a ramming appliance, they can serve for moving the hammer and for handling material to be rammed, such as piles and sheet piling.

Figure 2:
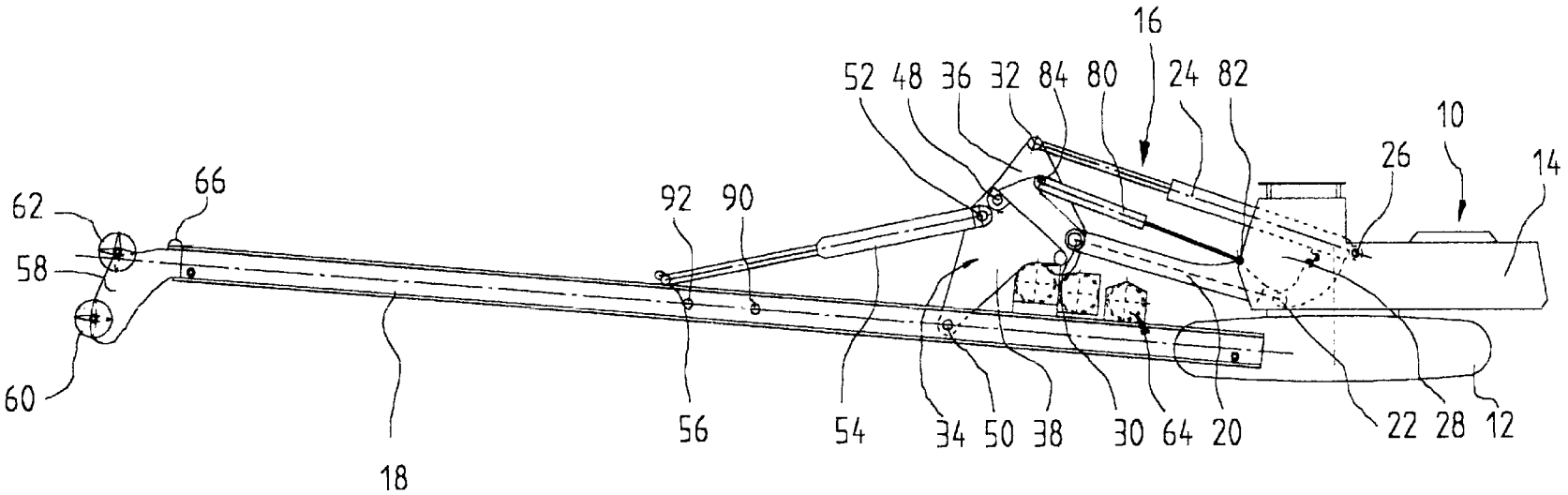
FIG. 2: shows a lateral view of the mobile working apparatus according to FIG. 1, wherein the leader is portrayed in an assembly position which is located in front of a travelling chassis belonging to the working apparatus and in which it extends substantially horizontally.
Figure 3:
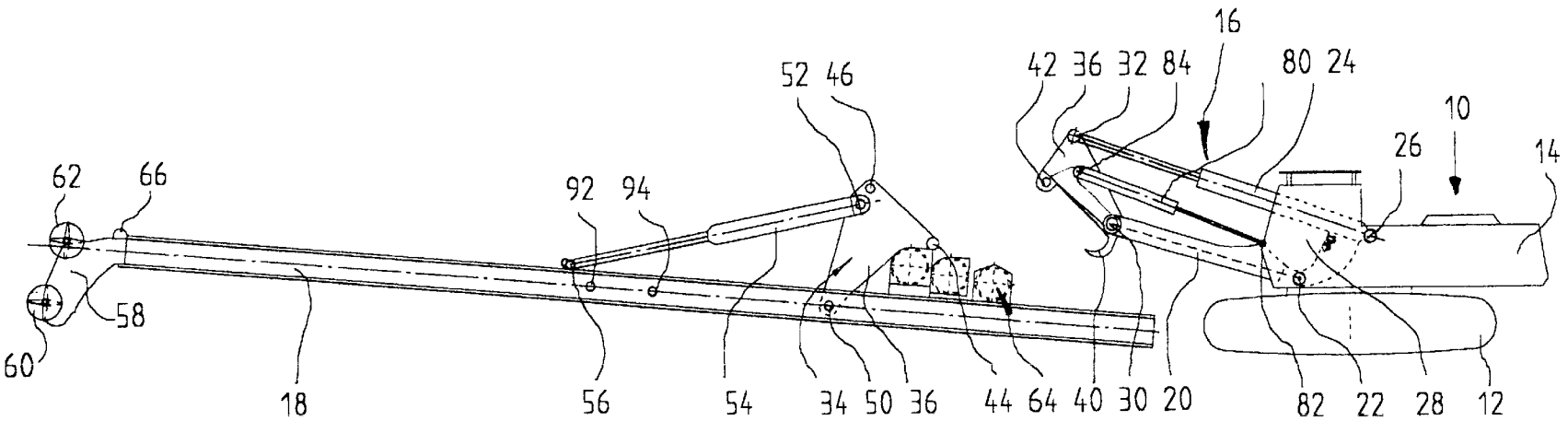
FIG. 3: shows a view which is similar to that in FIG. 2 but wherein the leader is portrayed in a condition detached from the travelling chassis.
Figure 4:
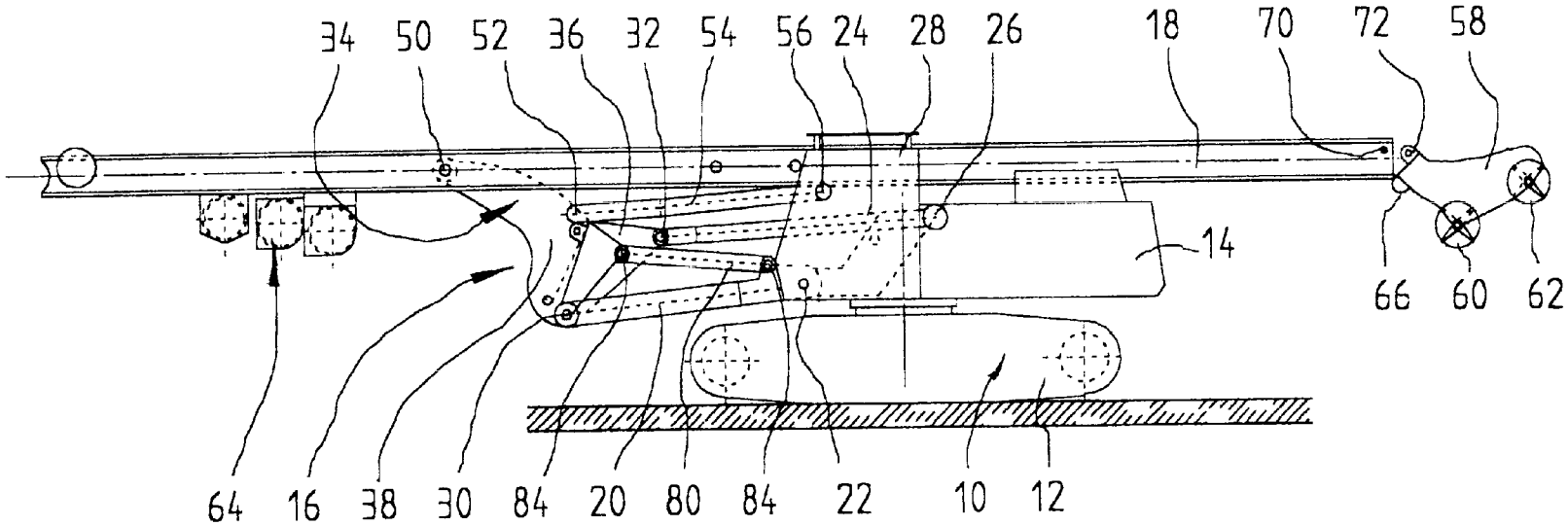
FIG. 4: shows a lateral view of the mobile working apparatus according to FIG. 1, in which the leader is now portrayed in a horizontal transport position in which it is folded down towards the rear.

The leader head segment 58 is connected to the leader 18 via a joint 66, so that it can be moved out of the aligned working position shown in FIGS. 1 to 3 and into a downwardly folded transport position which is portrayed in FIG. 4. In this way, the height of the working apparatus in the transport position is lessened. For the purpose of holding the leader head segment 58 in its working position, the said segment is secured on the upper end of the leader 18 via a pin 68 which interacts with a coupling aperture 70 in the leader 18 and also with a coupling aperture 72 in the leader head segment 58, which apertures are provided with reference symbols in FIG. 4.

The hydraulic working cylinder forming the second carrying guide arm 24 can be selectively connected by its working spaces to a pressure line 76 or return line 78 via a 4/3 magnetic valve 74. When the magnetic valve 74 is in a central position, the hydraulic working cylinder is locked.

A further hydraulic working cylinder 80 is connected, via pivot joints 82, 84, to a broadened end section of the carrying guide arm 20 and to the intermediate guide arm 34. Its two working spaces can be connected to the pressure line 76 and the return line 78 via a further 4/3 magnetic valve 86. The working cylinder 80 serves to swivel the guide-arm arrangement formed by the two carrying guide arms 20, 24. If the working cylinder 80 is acted upon by pressure for the purposes of extending its piston rod, the two carrying guide arms 20, 24 swivel in the anti-clockwise direction. If the working cylinder 80 is retracted, the carrying guide arms 20, 24 swivel in the clockwise direction.

If the hydraulic working cylinder forming the second carrying guide arm 24 is extended, the leader 18 is additionally pivoted in the anti-clockwise direction, in the process of which it conveys the carrying guide arms 20, 24 out of the geometry which is assumed when the working apparatus is in the working position and which substantially corresponds to the geometry of a parallelogram linkage, and into a trapezoidal geometry.

The same applies to the hydraulic working cylinder which forms the neck support 54 and which is connected to the pressure line 76 and the return line 78 via a further 4/3 magnetic valve 88.

The rotational movement of the leader 18 which takes place in the anti-clockwise direction between the working position shown in FIG. 1 and the assembly position shown in FIGS. 2 and 3, thus takes place as a result of the addition of three rotational movements which are obtained by extending the second carrying guide arm 24, by extending the neck support 54 and by extending the working cylinder 80.

By analogy, contributions to the 90° swivelling movement of the leader 18 in the clockwise direction into the transport position shown in FIG. 4 are obtained by retracting the second carrying guide arm 24, retracting the neck support 54 and retracting the working cylinder 80.

The leader-carrying mechanism 16 described in detail above thus permits both the letting-down of the carrier in front of the travelling chassis 10 and also the conveying of the leader 18 into a transport position in which it is located above the said travelling chassis 10. At the same time, the carrying mechanism as a whole has a compact design and can also serve to predetermine an obliquely standing working position of the leader, such as is needed, for example, for producing inclined boreholes.

The conveying of the leader 18 out of the vertical working position and into the horizontal assembly position or the horizontal transport position can be performed without the operating personnel having to release any connections on the leader.

When in the horizontal transport position represented in FIG. 4, the leader 18 can be taken off in the upward direction in order to further reduce the weight and space requirement of the working apparatus for the purpose of transporting it to a different place of use.

Figure 5:
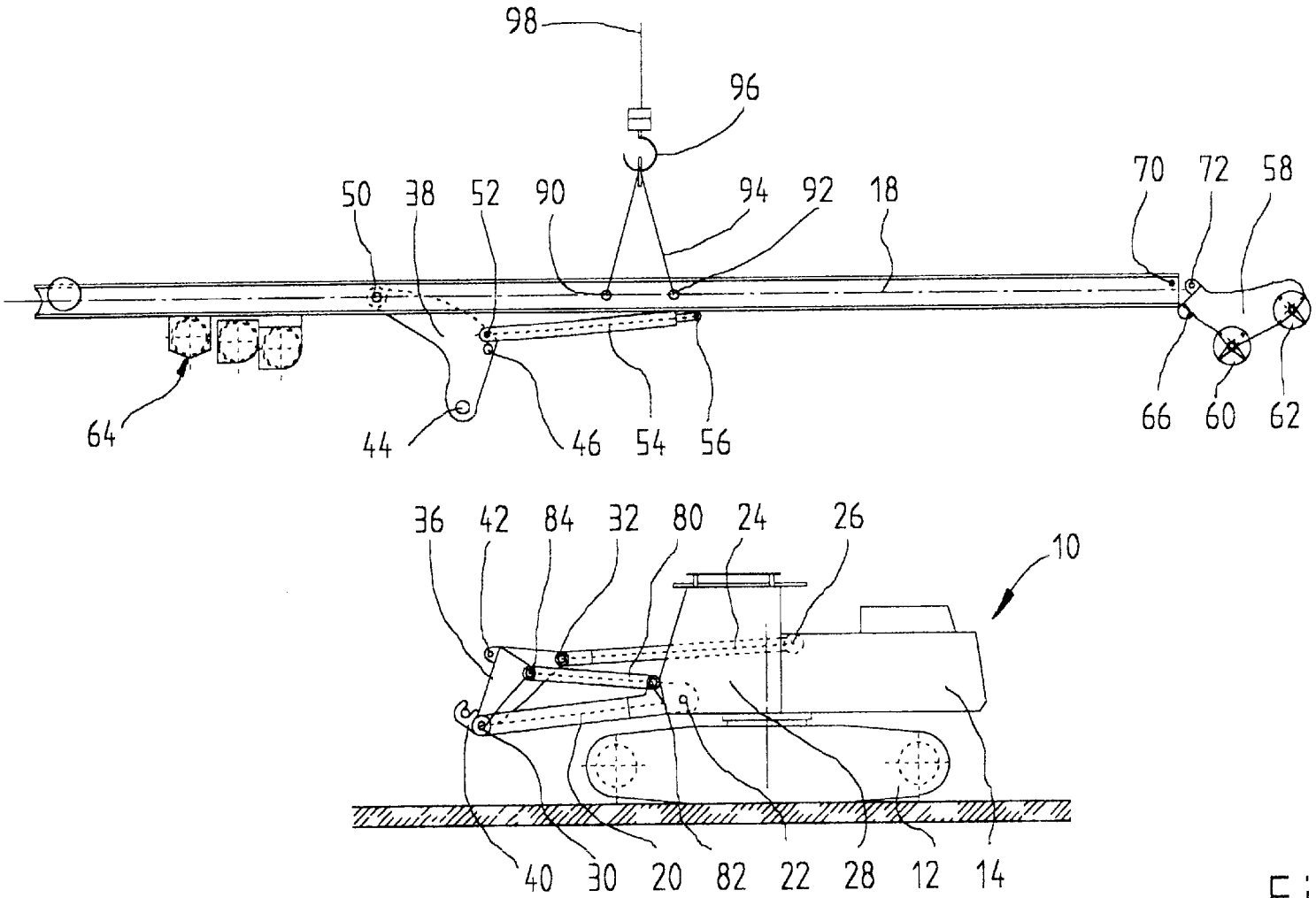
FIG. 5: shows a view which is similar to that in FIG. 4 and in which the leader is lifted off by a lifting appliance in order to lessen the weight, and further reduce the space requirement, of the working apparatus during transport operations.

To this end, cable apertures 90, 92 are provided in the leader, distributed around the centre of gravity of the latter. It is possible to draw through these, as shown in FIG. 5, a carrying cable 94 which can be hitched onto a hook 96 which, for its part, is held by a lifting cable 98 belonging to suitable lifting appliance (a crane or the like).

In the case of the travelling working apparatus described above, it is thus possible for the leader 18 to be removed or assembled (FIGS. 3 and 5 respectively) after being shifted towards the front or towards the rear, in the manner which is most favourable with respect to the local conditions encountered on each occasion.

In a modified exemplified embodiment which is not shown, the second carrying guide arm 24 is constructed as a telescopic strut which can be pinned in a different position.

In another exemplified embodiment which is not shown, the carrying guide arm 24 which can be varied in length is formed by a mechanical parallel circuit consisting of a double-acting hydraulic cylinder and a telescopic strut which can be pinned. In this way, the second carrying guide arm 24 can also be mechanically locked in its various positions.

The working apparatus described above is characterised by the following length ratios of the carrying mechanism 16, referred to the length of the first carrying guide arm 22:

| | |
|---|---|
| Length of the first carrying guide arm | 100% |
| Length of the second carrying guide arm | between about 100% and about 180% |
| Length of the neck-support arrangement | between about 90% and about 160% |
| Distance between the 1st pivot bearings | about 50% |
| Distance between the 2nd pivot bearings | about 50% |
| Distance between 3rd and 4th pivot bearings | about 50% |
| Distance of the 3rd pivot bearing from the lower end of the leader | about 160% |

What is claimed is:

1. A travelling working apparatus with a travelling chassis, with a leader which is carried via a carrying mechanism so as to be displaceable between a substantially vertical working position and a substantially horizontal assembly position, the carrying mechanism having a first carrying guide arm and a second carrying guide arm located at a distance from one another, said first carrying guide arm being located closer to said leader than said second carrying guide arm, the first ends of said first and second carrying guide arms being connected, via first pivot bearings located at a distance from one another, to the travelling chassis, and the second ends thereof being connected, via two pivot bearings located at a distance from one another, to an intermediate guide arm, indirectly associated with a travelling chassis, and connected to the leader via a third pivot bearing and carries, via a fourth pivot bearing a neck-support arrangement which acts on the leader with its free end via a fifth pivot bearing which is located at a distance from the third pivot bearing, wherein at least one of said first and said second carrying guide arms can be adjusted in its length.

2. The working apparatus as claimed in claim 1, wherein the carrying guide arm, which is adjustable in its length, has a telescopic strut which can be pinned.

3. The working apparatus as claimed in claim 1, wherein the carrying guide arm which is adjustable in its length, has a hydraulic working cylinder.

4. The working apparatus as claimed in claim 3, wherein there is a hydraulic locking system for the hydraulic working cylinder forming the carrying guide arm which is adjustable in length.

5. The working apparatus as claimed in claim 1, wherein the intermediate guide arm has two intermediate guide-arm parts which are connected via a releasable coupling and of which one is connected to the second pivot bearings and the other to the fourth pivot bearing.

6. The working apparatus as claimed in one of claim 1, wherein the length ratios of the carrying mechanism, referred to the length of said first carrying guide arm being closer to said leader, are as follows:

Length of the first carrying guide arm 100%

Length of the second carrying guide arm between about 100% and about 180%

Length of the neck-support arrangement between about 90% and about 160%

Distance between the $1^{st}$ pivot bearings about 50%

Distance between the $2^{nd}$ pivot bearings about 50%

Distance between the $3^{rd}$ and $4^{th}$ pivot bearings about 50%

Distance of the $3^{rd}$ pivot bearing from the lower end of the leader about 160%.

7. The working apparatus as claimed in claim 1, wherein the leader has a head segment which can be folded down in a releasable manner.

8. The working apparatus as claimed in claim 1, wherein the leader has means for attaching a lifting appliance.

9. The working apparatus as claimed in claim 1, further including a hydraulic working cylinder (80) provdied between said firet and second carrying guide arms which is, vai a sixth pivot bearing (82) of said first carrying guide arm, connected to the intermediate guide arm vai a seventh pivot bearing (84) which is located between the pivot bearings of said first and second carrying guide arms at said intermediate guide arm.

* * * * *

UNITED STATES PATENT AND TRADEMARK OFFICE

CERTIFICATE OF CORRECTION

PATENT NO. : 6,405,492 B1
DATED : June 18, 2002
INVENTOR(S) : Scheid et al.

It is certified that error appears in the above-identified patent and that said Letters Patent is hereby corrected as shown below:

Column 6,
Line 32, delete “provdied” and insert instead -- provided --.
Line 33, delete “firet” and insert instead -- first --.
Line 34, delete “vai” and insert instead -- via --.
Line 35, delete “vai” and insert instead -- via --.

Signed and Sealed this

Nineteenth Day of November, 2002

*Attest:*

*Attesting Officer*

JAMES E. ROGAN
*Director of the United States Patent and Trademark Office*